US008419279B2

(12) United States Patent
Borchardt

(10) Patent No.: US 8,419,279 B2
(45) Date of Patent: Apr. 16, 2013

(54) FLEXIBLE STORAGE BAG

(75) Inventor: Michael G. Borchardt, Naperville, IL (US)

(73) Assignee: The Glad Products Company, Oakland, CA (US)

( * ) Notice: Subject to any disclaimer, the term of this patent is extended or adjusted under 35 U.S.C. 154(b) by 489 days.

(21) Appl. No.: 12/535,030

(22) Filed: Aug. 4, 2009

(65) Prior Publication Data

US 2009/0290817 A1 Nov. 26, 2009

Related U.S. Application Data

(60) Continuation-in-part of application No. 10/880,784, filed on Jun. 29, 2004, now Pat. No. 7,726,880, and a division of application No. 11/381,604, filed on May 4, 2006, now Pat. No. 7,578,320.

(51) Int. Cl.
*B65D 33/01* (2006.01)
*B65D 33/00* (2006.01)

(52) U.S. Cl.
USPC ..... 383/103; 383/105

(58) Field of Classification Search ..... 383/105, 383/100–103
See application file for complete search history.

(56) References Cited

U.S. PATENT DOCUMENTS

| | | | |
|---|---|---|---|
| 2,142,970 | A | 1/1939 | Anderson |
| 2,778,173 | A | 8/1951 | Taunton |
| 2,576,322 | A | 11/1951 | Waters |
| 2,778,171 | A | 1/1957 | Taunton |
| 2,870,954 | A | 1/1959 | Kulesza |
| 2,913,030 | A | 11/1959 | Fisher |
| 2,927,722 | A | 3/1960 | Metzger |
| 2,946,502 | A | 7/1960 | Metzger |
| 3,054,551 | A | 9/1962 | Holbrook |
| 3,224,574 | A | 12/1965 | McConnell |
| 3,949,934 | A | 4/1976 | Goglio |

(Continued)

FOREIGN PATENT DOCUMENTS

| | | | |
|---|---|---|---|
| JP | 02233368 | A | 9/1990 |
| JP | 3212355 | A | 9/1991 |

(Continued)

OTHER PUBLICATIONS

International Search Report for PCT Application No. PCT/US05/22309, which claims priority to U.S. Appl. No. 10/880,784, Jun. 29, 2004.

(Continued)

*Primary Examiner* — Jes F Pascua
(74) *Attorney, Agent, or Firm* — Thomas Feix

(57) ABSTRACT

The flexible bag includes overlaying first and second sidewalls that provide an internal volume that can be accessed via an opening. To evacuate air from the internal volume after the open top edge has been closed, the bag includes a one-way valve element attached to the first sidewall. The bag is configured to prevent objects from clogging the valve element during evacuation. In one embodiment, the bag may include a plurality of ridges formed along the inner surface of at least one sidewall that can maintain separation of the sidewalls and contents from the valve element. In another aspect, the valve element is beneficially located at a top corner of the bag where the valve element is spaced apart from those locations in the bag where contents are likely to collect.

14 Claims, 13 Drawing Sheets

U.S. PATENT DOCUMENTS

| | | | | |
|---|---|---|---|---|
| 3,980,226 | A | 9/1976 | Franz | |
| RE30,045 | E | 7/1979 | Greene | |
| 4,295,566 | A | 10/1981 | Vincek | |
| 4,310,118 | A | 1/1982 | Kisida | |
| 4,601,410 | A | 7/1986 | Bond | |
| 4,653,661 | A | 3/1987 | Buchner et al. | |
| 4,702,376 | A | 10/1987 | Pagliaro | |
| 4,715,494 | A | 12/1987 | Heitzenrioder et al. | |
| 4,756,422 | A | 7/1988 | Kristen | |
| 4,941,310 | A | 7/1990 | Kristen | |
| 5,059,036 | A | 10/1991 | Richison | |
| 5,142,970 | A | 9/1992 | ErkenBrack | |
| 5,228,271 | A | 7/1993 | Wallace | |
| 5,240,112 | A | 8/1993 | Newburger | |
| 5,246,114 | A | 9/1993 | Underwood | |
| 5,332,095 | A | 7/1994 | Wu | |
| 5,333,736 | A | 8/1994 | Kawamura | |
| 5,388,910 | A | 2/1995 | Koyanagi | |
| RE34,929 | E | 5/1995 | Kristen | |
| 5,450,963 | A | 9/1995 | Carson | |
| 5,480,030 | A | 1/1996 | Sweeney et al. | |
| 5,540,500 | A | 7/1996 | Tanaka | |
| 5,544,752 | A | 8/1996 | Cox | |
| 5,584,409 | A | 12/1996 | Chemberlen | |
| 5,881,881 | A | 3/1999 | Carrington | |
| 5,931,189 | A | 8/1999 | Sweeney | |
| 5,954,196 | A | 9/1999 | Lin | |
| 5,989,608 | A | 11/1999 | Mizuno | |
| 5,996,800 | A | 12/1999 | Pratt | |
| 6,021,624 | A | 2/2000 | Richison et al. | |
| 6,039,182 | A | 3/2000 | Light | |
| 6,056,439 | A | 5/2000 | Graham | |
| 6,059,457 | A | 5/2000 | Sprehe et al. | |
| 6,070,397 | A | 6/2000 | Bachhuber | |
| 6,070,728 | A | 6/2000 | Overby | |
| 6,085,906 | A | 7/2000 | Lambert | |
| 6,116,781 | A | 9/2000 | Skeens | |
| 6,277,547 | B1 | 8/2001 | Bourdelais | |
| 6,357,915 | B2 | 3/2002 | Anderson | |
| 6,403,174 | B1 * | 6/2002 | Copeta | 428/34.1 |
| 6,408,872 | B1 | 6/2002 | Skeens | |
| 6,575,191 | B2 | 6/2003 | Skeens | |
| 6,581,641 | B2 | 6/2003 | Skeens et al. | |
| 6,604,634 | B2 | 8/2003 | Su | |
| 6,607,097 | B2 | 8/2003 | Savage | |
| 6,634,384 | B2 | 10/2003 | Skeens et al. | |
| 6,662,827 | B1 | 12/2003 | Clougherty et al. | |
| 6,715,644 | B2 | 4/2004 | Wilford | |
| 6,729,473 | B2 | 5/2004 | Anderson | |
| 6,799,680 | B2 | 10/2004 | Mak | |
| 6,814,991 | B2 | 11/2004 | Hiyoshi | |
| 6,837,268 | B2 | 1/2005 | Skeens | |
| 6,883,665 | B1 | 4/2005 | Ahn | |
| 6,983,845 | B2 | 1/2006 | Shah | |
| 6,991,109 | B1 | 1/2006 | Shannon | |
| 7,022,058 | B2 | 4/2006 | Lee | |
| 7,137,738 | B2 | 11/2006 | Shah | |
| 7,220,053 | B2 * | 5/2007 | Wu | 383/105 |
| 7,534,039 | B2 * | 5/2009 | Wu | 383/105 |
| 7,578,320 | B2 * | 8/2009 | Borchardt | 141/7 |
| 7,726,880 | B2 * | 6/2010 | Zimmerman et al. | 383/103 |
| 7,857,685 | B2 * | 12/2010 | Hogan | 452/141 |
| 7,887,238 | B2 * | 2/2011 | Turvey et al. | 383/105 |
| 7,938,581 | B2 * | 5/2011 | Ping | 383/100 |
| 2003/0024847 | A1 | 2/2003 | Malaspina | |
| 2003/0035597 | A1 | 2/2003 | Buckingham et al. | |
| 2003/0037519 | A1 | 2/2003 | Ishizaki | |
| 2003/0102245 | A1 | 6/2003 | Wang | |
| 2003/0136798 | A1 | 7/2003 | Wilford | |
| 2003/0155269 | A1 | 8/2003 | Lee | |
| 2004/0000501 | A1 | 1/2004 | Shah et al. | |
| 2004/0000502 | A1 | 1/2004 | Shah et al. | |
| 2004/0000503 | A1 | 1/2004 | Shah et al. | |
| 2004/0007494 | A1 | 1/2004 | Popeil et al. | |
| 2004/0050745 | A1 | 3/2004 | Lee | |
| 2004/0057636 | A1 | 3/2004 | Ishizaki | |
| 2004/0114837 | A1 | 6/2004 | Koyanagi | |
| 2004/0161178 | A1 | 8/2004 | Olechowski | |
| 2004/0211698 | A1 * | 10/2004 | John Mak | 206/524.8 |
| 2004/0223667 | A1 | 11/2004 | Shah et al. | |
| 2004/0238397 | A1 | 12/2004 | Yu et al. | |
| 2005/0025396 | A1 | 2/2005 | ErkenBrack | |
| 2005/0034806 | A1 | 2/2005 | Wu et al. | |
| 2005/0036717 | A1 | 2/2005 | Wu | |
| 2005/0036718 | A1 | 2/2005 | Wu | |
| 2005/0036719 | A1 | 2/2005 | Wu | |
| 2005/0037163 | A1 | 2/2005 | Wu | |
| 2005/0037164 | A1 | 2/2005 | Wu | |
| 2005/0065007 | A1 | 3/2005 | Wu et al. | |
| 2005/0143243 | A1 | 6/2005 | Lee | |
| 2005/0147330 | A1 | 7/2005 | Lee | |
| 2005/0147774 | A1 | 7/2005 | Lee | |
| 2005/0172577 | A1 | 8/2005 | Oltrogge | |
| 2005/0178691 | A1 | 8/2005 | Frenkil | |
| 2005/0205455 | A1 | 9/2005 | Harrison | |
| 2005/0220373 | A1 | 10/2005 | Wu | |
| 2005/0220942 | A1 | 10/2005 | Wu | |
| 2005/0238263 | A1 | 10/2005 | Ping | |
| 2005/0244083 | A1 | 11/2005 | McMahon | |
| 2005/0286808 | A1 | 12/2005 | Zimmerman | |
| 2006/0030472 | A1 | 2/2006 | Hartman | |
| 2006/0050999 | A1 | 3/2006 | Blythe et al. | |
| 2006/0072860 | A1 * | 4/2006 | Wu | 383/101 |
| 2006/0073291 | A1 | 4/2006 | Wu | |
| 2006/0120632 | A1 | 6/2006 | Han | |
| 2008/0199110 | A1 * | 8/2008 | Anderson et al. | 383/109 |
| 2008/0264821 | A1 * | 10/2008 | Liang | 206/524.8 |
| 2011/0085748 | A1 * | 4/2011 | Turvey et al. | 383/100 |

FOREIGN PATENT DOCUMENTS

| | | | |
|---|---|---|---|
| JP | 4242544 | A | 8/1992 |
| JP | 8198274 | A | 8/1996 |
| JP | 8301358 | A | 11/1996 |
| JP | 10139050 | A | 5/1998 |
| JP | 2000118540 | A | 4/2000 |
| JP | 2006082872 | A | 3/2006 |
| WO | WO9413556 | A1 | 6/1994 |
| WO | WO9833717 | A1 | 8/1998 |
| WO | WO02/046044 | A1 | 6/2002 |
| WO | WO2004/002840 | | 1/2004 |
| WO | WO2004/002841 | | 1/2004 |
| WO | WO2005/000706 | | 1/2005 |
| WO | WO2005/002976 | A1 | 1/2005 |
| WO | WO2005/012107 | A1 | 2/2005 |
| WO | WO2005/016774 | A1 | 2/2005 |
| WO | WO2005/040005 | A1 | 5/2005 |

OTHER PUBLICATIONS

Non-Final Office Action mailed Dec. 31, 2008 for related U.S. Appl. No. 10/880,784, Jun. 29, 2004.

Non-Final Office Action mailed Feb. 3, 2009 for related U.S. Appl. No. 12/208,868, Sep. 11, 2008.

Non-Final Office Action mailed Dec. 15, 2008 for related U.S. Appl. No. 11/467,269, Aug. 25, 2006.

Final Office Action mailed Nov. 18, 2008 for related U.S. Appl. No. 11/467,257, Aug. 25, 2006.

Final Office Action mailed Nov. 18, 2008 for related U.S. Appl. No. 11/467,262, Aug. 25, 2006.

* cited by examiner

FIG. 4
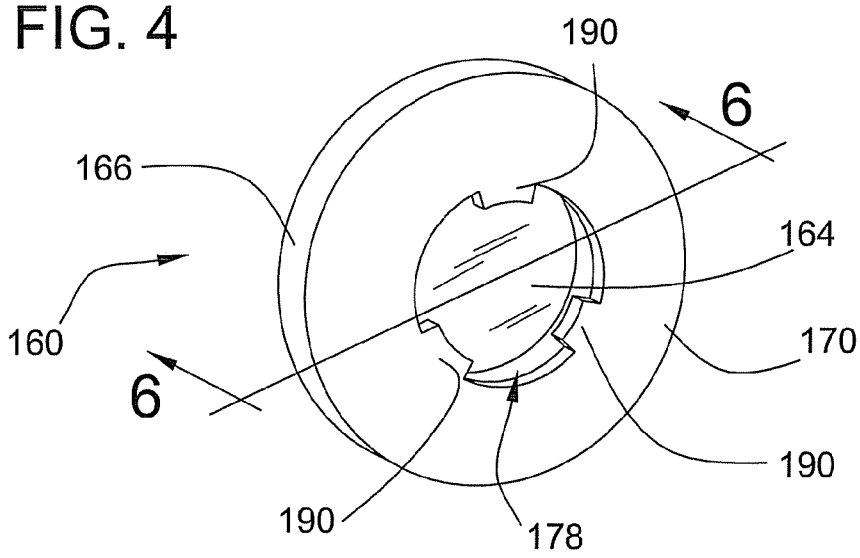
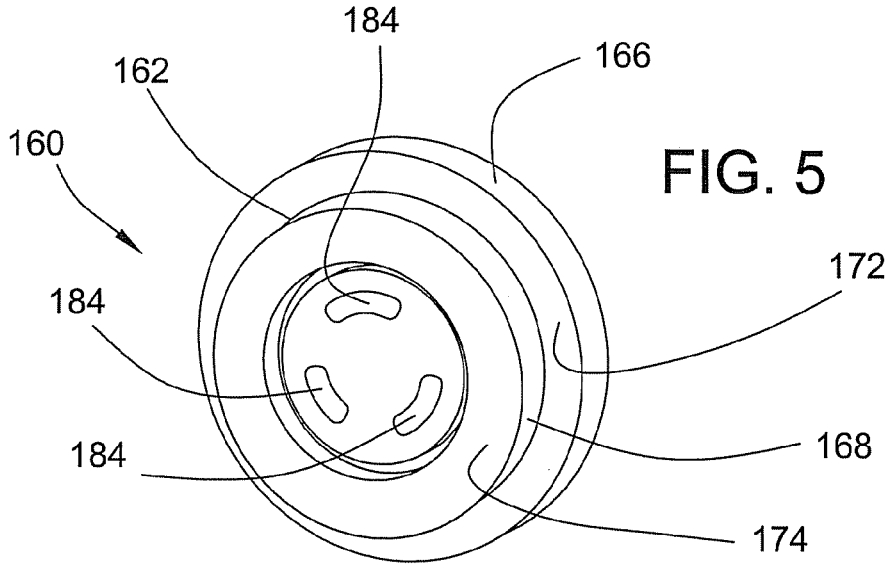
FIG. 5
FIG. 6
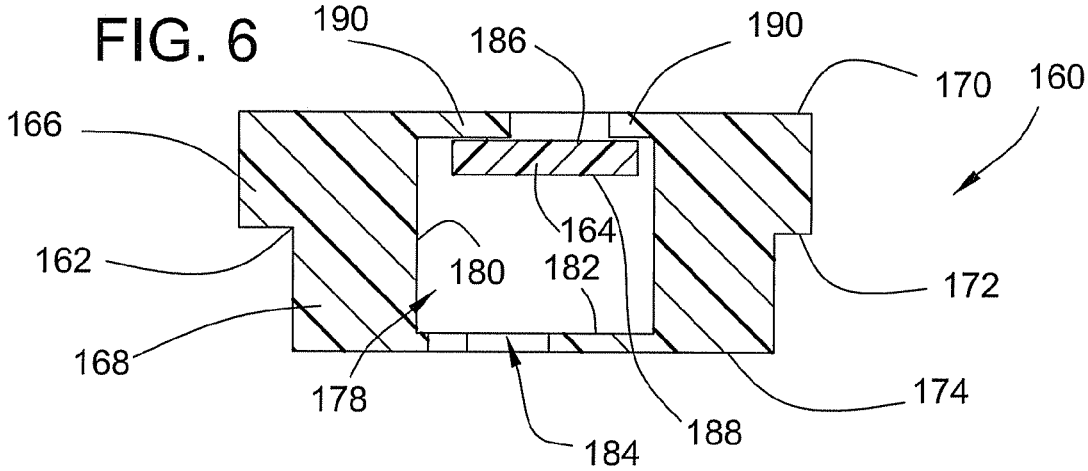

FLEXIBLE STORAGE BAG

CROSS-REFERENCE TO RELATED APPLICATIONS

This patent application is a continuation-in-part of U.S. patent application Ser. No. 10/880,784, titled "Flexible Storage Bag", filed on Jun. 29, 2004, now U.S. Pat. No. 7,726,880 and a division of U.S. patent application Ser. No. 11/381,604, titled "Flexible Storage Bag", filed on May 4, 2006, now U.S. Pat. No. 7,578,320, both of which are herein incorporated by reference in their entirety.

FIELD OF THE INVENTION

This invention pertains generally to storage containers and more particularly to flexible storage bags designed to be sealed and evacuated. The invention finds particular applicability in the field of food storage.

BACKGROUND OF THE INVENTION

Flexible plastic bags are widely used for a variety of purposes such as storing food items, either temporarily as in the case of packaging snacks or long term as in the case of freezer storage. Plastic bags of this style typically include flexible sidewalls made from, for example, polyethylene, that define an opening and an internal volume accessible through the opening. To seal the bag, interlocking closure strips may be provided about the rim of the opening.

One common problem which occurs with such bags is that, after the opening has been sealed, latent air may remain trapped in the internal volume. In addition to undesirably increasing the overall size of the sealed bag, the trapped air can cause spoilage of food items stored in the internal volume. Therefore, to remedy this problem, it is known to provide a one-way valve element attached to a flexible sidewall and communicating with the internal volume. The one-way valve element allows for the evacuation of the trapped air from the internal volume while also preventing the ingress of air from the surrounding environment into the internal volume. The one-way valve element may be activated in various ways such as, for example, by applying compressive pressure to the flexible sidewalls to force air from the internal volume or by interfacing a nozzle of a vacuum source with the one-way valve element to draw air from the internal volume. An example of a one-way valve element that operates in conjunction with a vacuum source is provided in U.S. Pat. No. 6,581,641.

A problem that may arise with such bags that include one-way valve elements is that objects may clog the valve element thereby preventing further evacuation. For example, the flexible sidewalls proximate the valve element may actually be drawn into or otherwise enter the valve element. Furthermore, the contents of the bag itself may result in similar clogging. A related problem is that collapsing the opposing sidewalls themselves together may trap air in other portions of the internal volume. These and other problems are addressed by the invention described herein.

BRIEF SUMMARY OF THE INVENTION

The invention overcomes clogging of the one-way valve element by maintaining separation of the valve element away from those objects that could be drawn into or otherwise enter it. In one aspect, to maintain separation of the valve element, the bag may have a plurality of elongated ridges protruding from and extending along an inner surface of the flexible sidewall. The ridges may be spaced apart from each other to provide channels or grooves therebetween. Hence, as the opposing sidewalls collapse together and toward the valve element during evacuation, they come to abut against the protruding ridges such that separation from the valve element and from each other is maintained. Air from the interior volume, however, can continue to pass along the channels or grooves to reach the valve element and exit the bag. To further facilitate air flow within the interior volume, the elongated ridges may have discontinuities or notches formed there along that allows air to pass across the ridges.

In another aspect of the invention, to maintain separation of the valve element from potentially clogging elements, the valve element may be attached at a beneficial location, specifically, proximate the intersection of the opening and the sealed sidewall. For example, in a rectangular or square bag having one edge unsealed to provide the opening, the valve element can be located proximate the corner formed by a sealed side edge and the opening. In such a location, the valve element is separated from both the closed bottom edge and the center of the bag, two locations where contents are likely to collect. Hence, when the bag is evacuated, contents are less likely to be drawn into and thereby clog the valve element.

Thus, an advantage of the invention is that it prevents the one-way valve element from becoming clogged during evacuation. Another advantage is that it hinders the opposing sidewalls from collapsing together and thereby prevents the trapping of air within the internal volume. A related advantage is that the invention facilitates evacuation of air from the internal volume to, for example, preserve food items. These and other advantages and features of the invention will become apparent from the detailed description and the accompanying drawings.

BRIEF DESCRIPTION OF THE DRAWINGS

FIG. 4 is a front perspective view of another embodiment of a one-way valve element for attachment to the flexible bag of FIG. 1.

FIG. 5 is a rear perspective view of the one-way valve element of FIG. 4.

FIG. 6 is a cross-sectional view through the one-way valve element, as taken along line 6-6 of FIG. 4.

DETAILED DESCRIPTION OF THE EMBODIMENTS

Figure 1:
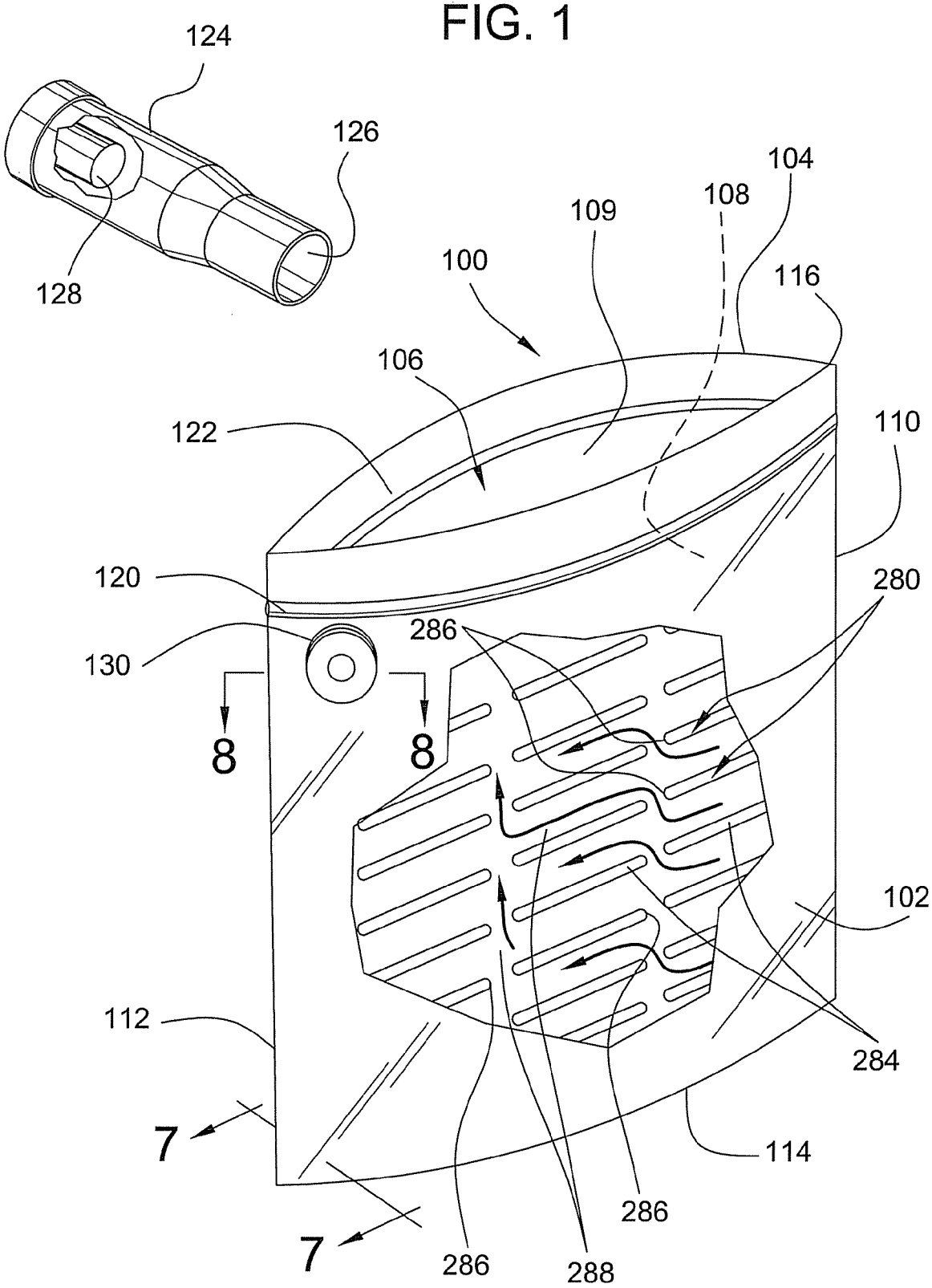
FIG. 1 is a perspective view of a flexible bag having attached to the sidewall and communicating with the interior volume a one-way valve element with an interior surface having elongated ridges shown in break-away.

Now referring to the drawings wherein like reference numbers refer to like elements, there is illustrated in FIG. 1 an flexible bag 100 designed in accordance with the teachings of the invention. In the illustrated embodiment, the flexible bag 100 includes a first sidewall 102 and an opposing second sidewall 104 overlaying the first sidewall 102 to define an internal volume 106. Accordingly, the first and second sidewall 102, 104 each includes a respective first inner surface 108 and an opposing second inner surface 109.

The first and second sidewalls 102, 104 can be made from flexible webs of thermoplastic material such as, for example, polyethylene. The webs may be monolayer or multilayer film typically used for food storage. Multilayer films may be laminations or coextrusions. Resins may include polyethylene including high density (HDPE), low density (LDPE), linear low density (LLDPE), nylon, ethylene vinyl alcohol (EVOH), polypropylene (PP), ethylene vinyl acetate (EVA), polyester, ionomers or metallized films. Examples of coextruded multilayer film suitable for the current invention include layered combinations such as HDPE/tie-layer/EVOH/tie-layer/LDPE or nylon/tie-layer/LDPE. For heat sealing, the sealant may be a blend of materials such that when the bag is opened the peel does not result in destruction of the bag. One such sealant material would consist of a blend of LDPE and polybutene-1 commonly referred to as a peel-seal resin whereby polybutene-1 is the minor phase.

The first and second sidewalls 102, 104 are partially sealed together along their peripheral edges. In the illustrated embodiment, the sealed edges include a first side edge 110, a parallel second side edge 112, and a closed bottom edge 114 that extends perpendicularly between the first and second side edges. To access the internal volume 106, the portions of the first and second sidewalls 102, 104 extending along an open top edge 116 remain unsealed. Due to the four orthogonal edges, the flexible bag 100 has a generally rectangular shape. However, it will be appreciated that in other embodiments, the bag can have any suitable shape resulting from any number of sidewalls and edges.

To releasably close the opened top end 116 after insertion of an item for storage, there is attached to first and second sidewalls 102, 104 and extending parallel to the open top edge 116 respective first and second fastening strips 120, 122. The first and second fastening strips 120, 122 can be formed from extruded, flexible thermoplastic and extend between the first and second side edges 110, 112. As will be appreciated by those of skill in the art, the first and second fastening strips 120, 122 can engage to form a seal which closes the open top edge 116. Of course, in other embodiments or in combination with the interlocking strips, other methods such as the use of pressure sensitive or cold seal adhesives such as those disclosed in U.S. Pat. No. 6,149,304, herein incorporated by reference in its entirety, heat-sealing, or cling can be employed to seal the open top edge.

To evacuate air trapped in the flexible bag 100 after sealing the open top edge 116, the bag includes a one-way valve element 130 that is attached to the first sidewall 102 and communicates with the internal volume 106. The one-way valve element 130 is capable of opening to allow entrapped air from the internal volume 106 to escape and closing to prevent the ingress of environmental air into the internal volume. Communication with the internal volume 106 can be accomplished by disposing an opening through the first sidewall 102 and then attaching the valve element 130 over the opening.

The removal of air from the interior volume 106 can be accomplished in any suitable manner. For example, it will be appreciated that applying compressive pressure to the first and second sidewalls 102, 104 to squeeze the bag will force air from the internal volume to open and exhaust through the valve element. Additionally, in other embodiments, an external evacuation device can be provided that draws air through the valve element. In the illustrated embodiment, the evacuation device 124 is configured as a hand held device that includes an elongated housing with an inlet opening 126. Located inside the housing is an electrically operated air flow generating unit 128 that generates a suction pressure at the inlet opening 126. Hence, when the inlet opening 126 is placed against or about the valve element 130 and the air flow generating unit 128 is activated, the suction pressure opens the valve element and draws air from the internal volume 106. In other embodiments, the evacuation device can be configured as a table mounted unit.

Figure 2:
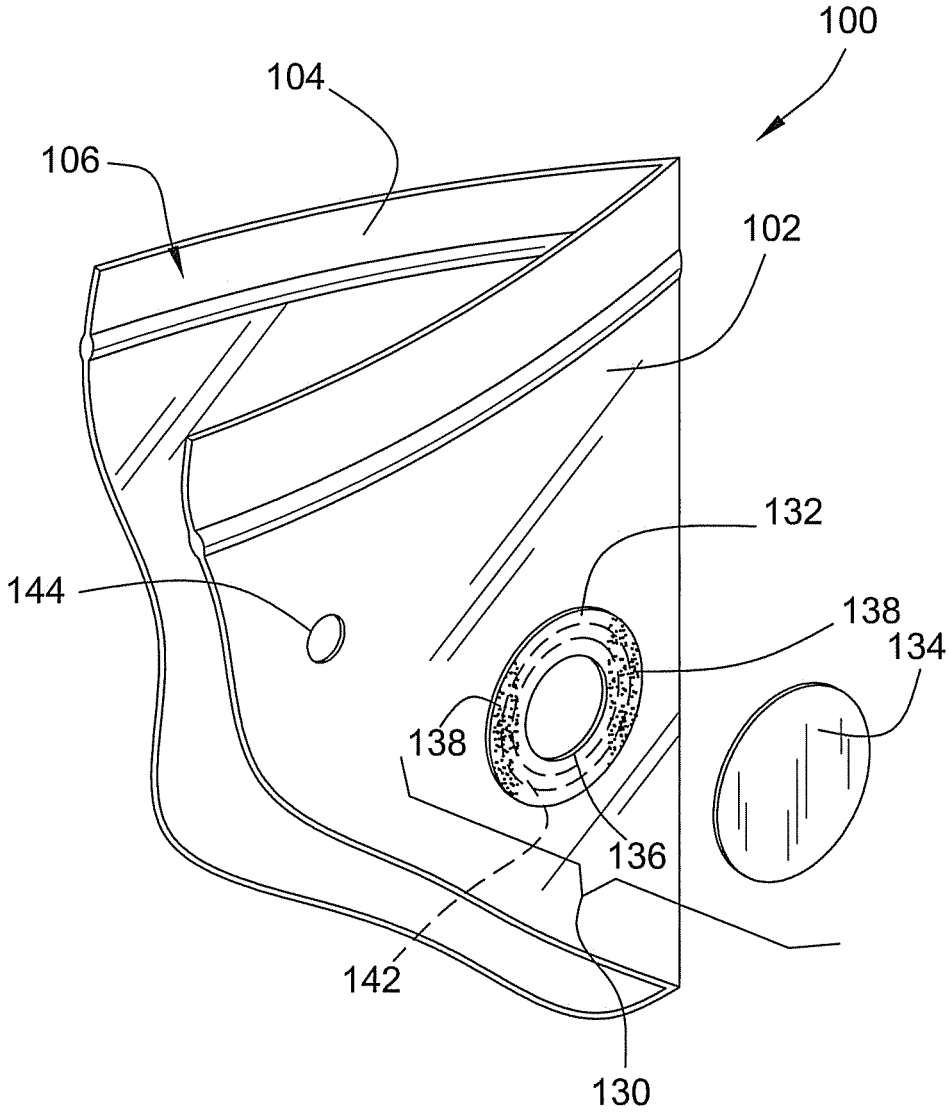
FIG. 2 is an exploded view of an embodiment of the one-way valve element for attachment to the flexible bag of FIG. 1.

Referring to FIG. 2, in an embodiment, the one-way valve element 130 is constructed as a flexible, multi-layered valve element. The illustrated valve element 130 can include a flexible, circular base layer 132 that cooperates with a correspondingly circular shaped, resilient top layer 134 to open and close the valve element. The top and bottom layers can be made from any suitable material such as, for example, a flexible thermoplastic film. Disposed through the center of the base layer 132 is an aperture 136, thus providing the base layer with an annular shape. The top layer 134 may be adhered to the base layer 132 by two parallel strips of adhesive 138 that extend along either side of the aperture 136, thereby covering the aperture with the top layer and forming a channel. The base layer 132 and top layer 134 are then adhered by a ring of adhesive 142 to the flexible bag 100 so as to cover the hole 144 disposed through the first sidewall 102.

When the sidewalls 102, 104 of the bag 100 are forcibly compressed together or a vacuum device is interfaced with the valve element, air from the internal volume 106 will pass through the hole 144 and the aperture 136 thereby partially displacing the top layer 134 from the base layer 132. The air can then pass along the channel formed between the adhesive strips 138 and escape to the environment. When the force on the sidewalls 102, 104 is released or the vacuum device is deactivated, the resilient top layer 134 will return to its prior configuration covering and sealing the aperture 136. The valve element 130 may also contain a viscous material such as an oil, grease, or lubricant between the two layers in order to prevent air from reentering the bag. In an embodiment, base layer 132 may also be a rigid sheet material. In another embodiment, the base layer 132 may be eliminated and the top layer 134 may be adhered by strips of adhesive to the sidewall. In another embodiment, the hole may be a slit or slits in the sidewall.

Figure 3:
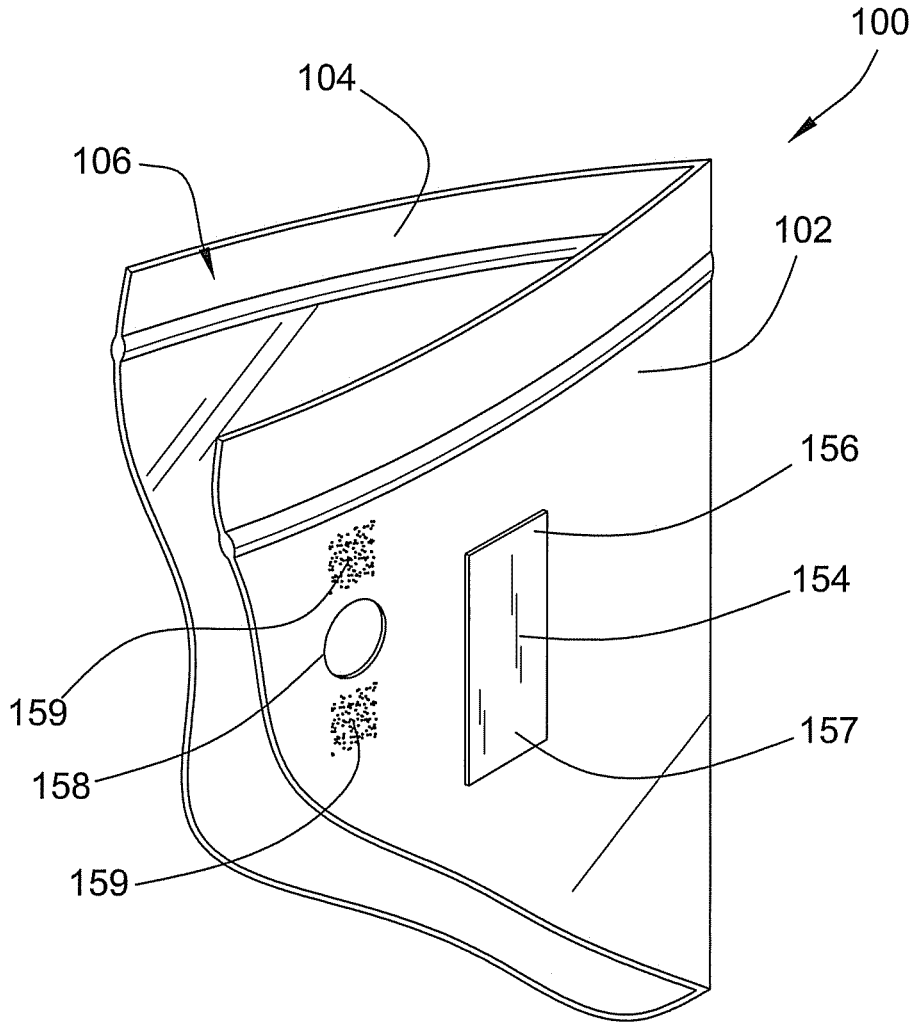
FIG. 3 is an exploded view of another embodiment of the one-way valve element for attachment to the flexible bag of FIG. 1.

Illustrated in FIG. 3 is another embodiment of the valve element 154 that can be attached to the flexible plastic bag 100. The valve element 154 is a rectangular piece of flexible thermoplastic film that includes a first end 156 and a second end 157. The valve element 154 is attached to the first sidewall 102 so as to cover and seal a hole 158 disposed through the first sidewall 102. The valve element 154 can be attached to the sidewall 102 by patches of adhesive 159 placed on either side of the hole 158 so as to correspond to the first and second ends 156, 157. When the sidewalls 102, 104 of the flexible bag 100 are collapsed together, air from the internal volume 106 displaces the flexible valve element 154 so as to unseal the hole 158. After evacuation of air from the internal volume 106, the valve element 154 will again cover and seal the hole 158. In another embodiment, the hole may be a slit or slits in the sidewall.

Referring to FIGS. 4, 5 and 6, in another embodiment, the one-way valve element 160 can include a rigid valve body 162 that cooperates with a movable disk 164 to open and close the valve element. The valve body 162 includes a circular flange portion 166 extending between parallel first and second flange faces 170, 172. Concentric to the flange portion and projecting from the second flange face 172 is a circular boss portion 168 which terminates in a planar boss face 174 that is parallel to the first and second flange faces. The circular boss portion 168 is smaller in diameter than the flange portion 166 so that the outermost annular rim of the second flange face 172 remains exposed. The valve body 162 can be made from any suitable material such as a moldable thermoplastic material like nylon, HDPE, high impact polystyrene (HIPS), polycarbonates (PC), and the like.

Disposed concentrically into the valve body 162 is a counter-bore 178. The counter-bore extends from the first flange face 170 part way towards the boss face 174. The counter-bore 178 defines a cylindrical bore wall 180. Because it extends only part way toward the boss face 174, the counter-bore 178 may form within the valve body 162 a planar valve seat 182. To establish fluid communication across the valve body, there is disposed through the valve seat 182 at least one aperture 184. In fact, in the illustrated embodiment, a plurality of apertures 184 are arranged concentrically and spaced inwardly from the cylindrical bore wall 180.

To cooperatively accommodate the movable disk 164, the disk is inserted into the counter-bore 178. Accordingly, the disk 164 is preferably smaller in diameter than the counter-bore 178 and has a thickness as measured between a first disk face 186 and a second disk face 188 that is substantially less than the length of the counter-bore 178 between the first flange face 170 and the valve seat 182. To retain the disk 164 within the counter-bore 178, there is formed proximate to the first flange face 170 a plurality of radially inward extending fingers 190. The disk 164 can be made from any suitable material such as, for example, a resilient elastomer.

Referring to FIG. 6, when the disk 164 within the counter-bore 178 is moved adjacent to the fingers 190, the valve element 160 is in its open configuration allowing air to communicate between the first flange face 170 and the boss face 174. However, when the disk 164 is adjacent the valve seat 182 thereby covering the apertures 184, the valve element 160 is in its closed configuration. To assist in sealing the disk 164 over the apertures 184, a sealing liquid can be applied to the valve seat 182. Furthermore, a foam or other resilient member may be placed in the counter-bore 178 to provide a tight fit of the disk 164 and the valve seat 182 in the closed position. However, when the valve element 160 is attached to the first sidewall with the boss face 174 and apertures 184 exposed to the interior volume, air escaping from the internal volume will move the movable disk 164 against the fingers 190 and allowing air to escape to the environment. Afterwards, the disk can again move adjacent the valve seat 182 to cover the apertures 184.

Referring back to FIG. 1 and from the foregoing description, it will be appreciated that objects within the bag 100 or the sidewalls 102, 104 can clog the valve element 130 during evacuation. To prevent this from happening, and in accordance with the teachings of the invention, the bag is configured to maintain separation of the valve element from potential clogging objects.

In one aspect of the invention illustrated in FIG. 1, separation is maintained by including along at least one inner surface of the sidewalls a plurality of elongated ridges 280 that protrude into the interior volume 106. More specifically, the elongated ridges 280 are illustrated extending along the interior surface 109 of the second sidewall 102 and can be arranged in generally straight lines running parallel to one another. The ridges 280 can extend horizontally across the width of the bag 100 between the first side edge 110 and second side edge 112 as illustrated. Of course, it should be recognized that the ridges can also extend vertically between the bottom edge 114 and proximate the open top edge 116, diagonally, or in any other suitable pattern. Ridges can also be included on the inner surface 108 of the first sidewall in a similar or different pattern. The sidewall may include one, two, three, four, five or more ridges.

Figure 7:
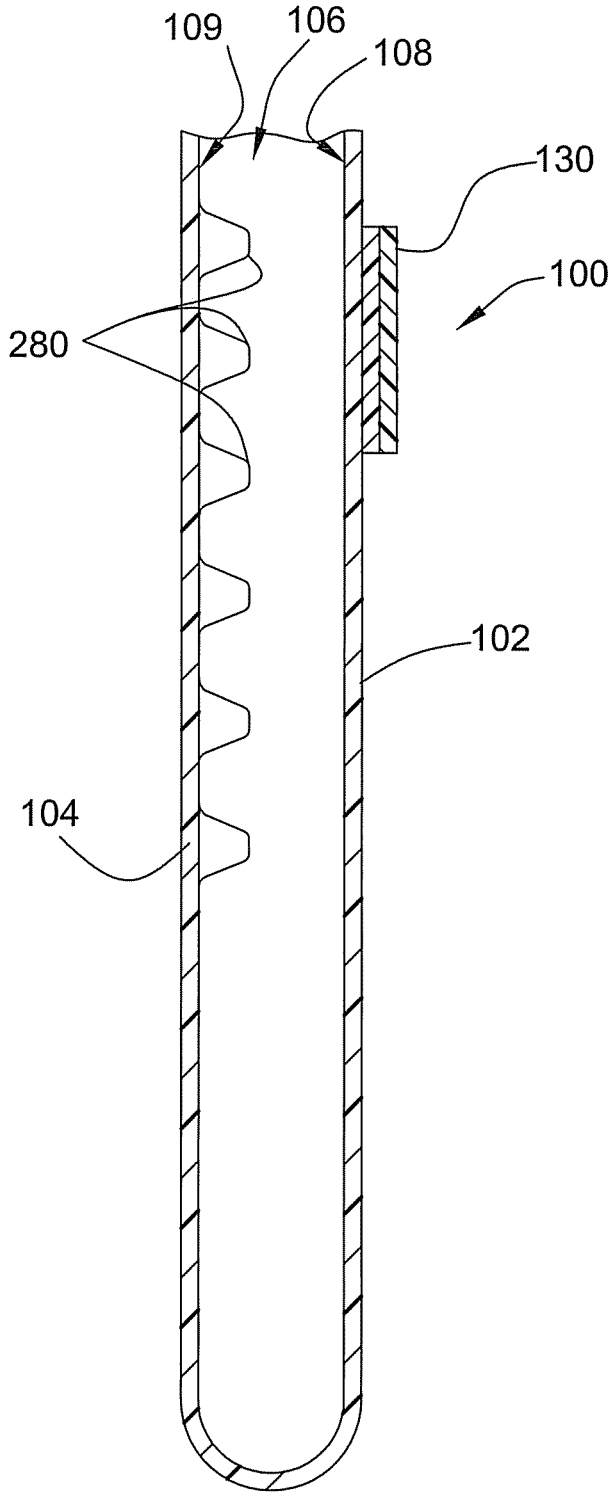
FIG. 7 is a cross-sectional view taken along line 7-7 through the bag of FIG. 1, wherein ridges are provided on the second sidewall only.

The ridges can be included on one of the sidewalls or both of the sidewalls. For example, referring to FIG. 7, the ridges 280 only protrude from the inner surface 109 of the second sidewall 104. However, referring to FIG. 8, a second group of ridges 182 can protrude from the inner surface 108 of the first sidewall 102 to which the valve element 130 is attached. The ridges can have any suitable height. For example, referring to FIG. 7, the ridges 280 may protrude a distance 283 in a first range between 0.001 inches (0.00254 cm) and 0.050 inches (0.127 cm) from the inner surface 108 of the first sidewall 102. In a second range, the distance 283 may be between 0.01 inches (0.0254 cm) and 0.035 inches (0.0889 cm). In a third range, the distance 283 may be between 0.01 (inches (0.0254 cm) and 0.020 inches (0.058 cm).

In operation, as the bag 100 is evacuated and the sidewalls 102, 104 collapse together, the protruding ridges function to prevent potential clogging hazards from entering the valve element 130. For example, referring to FIG. 7, with the ridges 280 on the second sidewall 104 located to correspond generally to the valve element 130, it will be appreciated that the ridges 280 will abut against the first sidewall 102 and thereby prevent the second sidewall 104 from clogging the valve element. Moreover, in the embodiment illustrated in FIG. 8, as the sidewalls 102, 104 collapse together, the ridges 280, 282 on both sidewalls will encounter one another and thereby maintain spacing between the sidewalls and the valve element. It should further be appreciated that the ridges 280, 282 will also function to block large solid objects such as the bag's contents, for example, food, from accessing the valve element 130.

Figure 8:
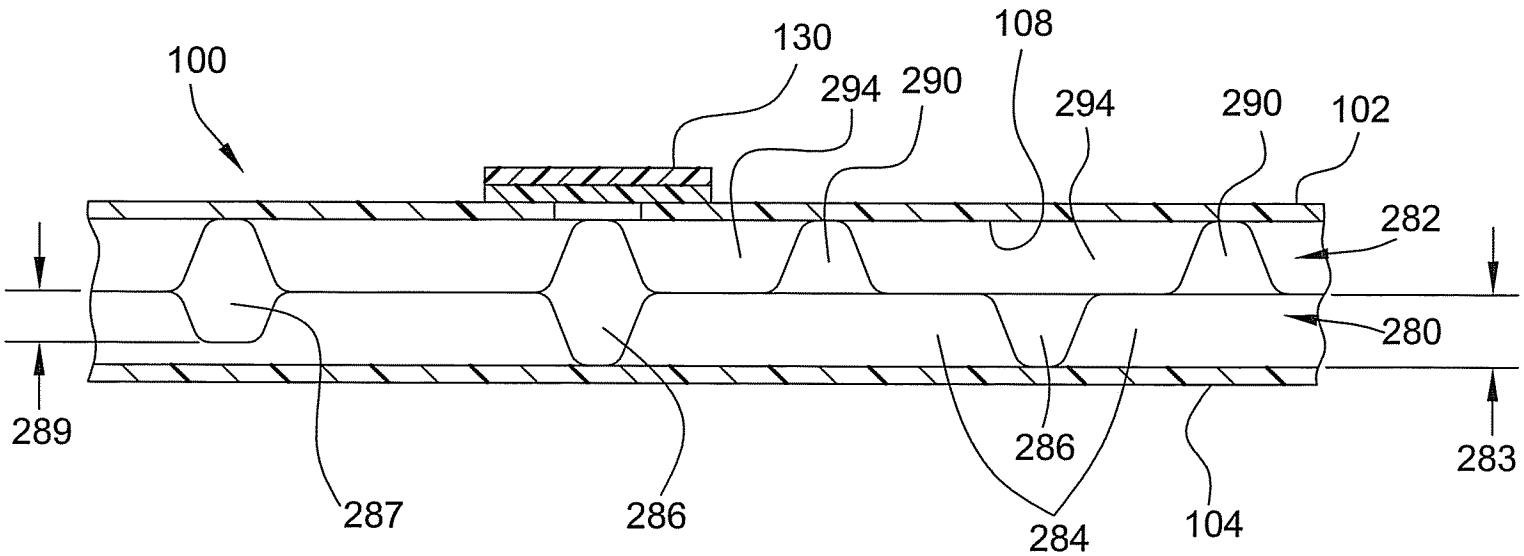
FIG. 8 is a cross-sectional view taken along line 8-8 through the bag of FIG. 1, wherein ridges are provided on both the first and second sidewalls.

To facilitate access or flow to the valve element by air trapped in different regions within the bag, discontinuities or notches can be formed into the ridges. For example, referring to FIG. 1, the notches 286 are spaced along the ridges 280 of the second sidewall 104 such that each ridge is broken into separate, aligned ridge segments 284. Referring to FIG. 8, a second group of notches 290 are disposed along the ridges 282 on the first sidewall 102 such that each ridge is likewise broken into separate, aligned ridge segments 294. The notches can have any suitable size appropriate for the situation. For example, in a first range, the length of the notch may be 1% to 50% of the length of the ridge. In a second range, the length of the notch may be 5% to 30% of the length of the ridge. In a third range, the length of the notch may be 5% to 10% of the length of the ridge. The depth of the notch can also have any suitable size appropriate for the situation. For example, the notch can extend from the tip of the ridge to the inner surface of the respective sidewall, therefore across the entire height of the ridge and thus, the depth of the notch is 100% of the height of the ridge. In addition, the depth of the notch may be less than the height of the ridge. For example, the notch 287 has a depth 289 as shown in FIG. 8. In a first range, the depth of the notch may be 1% to 100% of the height of the ridge. In a second range, the depth of the notch may be 25% to 100% of the height of the ridge. In a third range, the depth of the notch may be 50% to 100% of the height of the ridge. In a fourth range, the depth of the notch may be 75% to 100% of the height of the ridge. Referring back to FIG. 1, during evacuation, air inside the bag can pass across the notches 286 around the ridge segments 284 to access the valve element 130 as indicated by arrows 288. Hence, the notches function to remove air that may otherwise remain trapped in different regions within the bag.

To fabricate the ridges on an inner surface of a bag sidewall, a material for the ridges can be directly extruded onto a web of flexible, thermoplastic material that will provide the sidewall material. For example, referring to FIGS. 9 and 10, a roll 300 of thermoplastic material can be provided from which a web 302 is unwound and advanced in a machine direction indicated by arrow 304. This portion of the process is represented by step 301 of the flowchart in FIG. 10. The web 302 can be advanced past an extrusion apparatus 306 from which parallel lines 308 of ridge material are extruded onto the passing web. The lines of ridge material become the protruding ridges 310 on the web. The ridge material may be a thermoplastic material, an adhesive material or another material.

Figure 9:
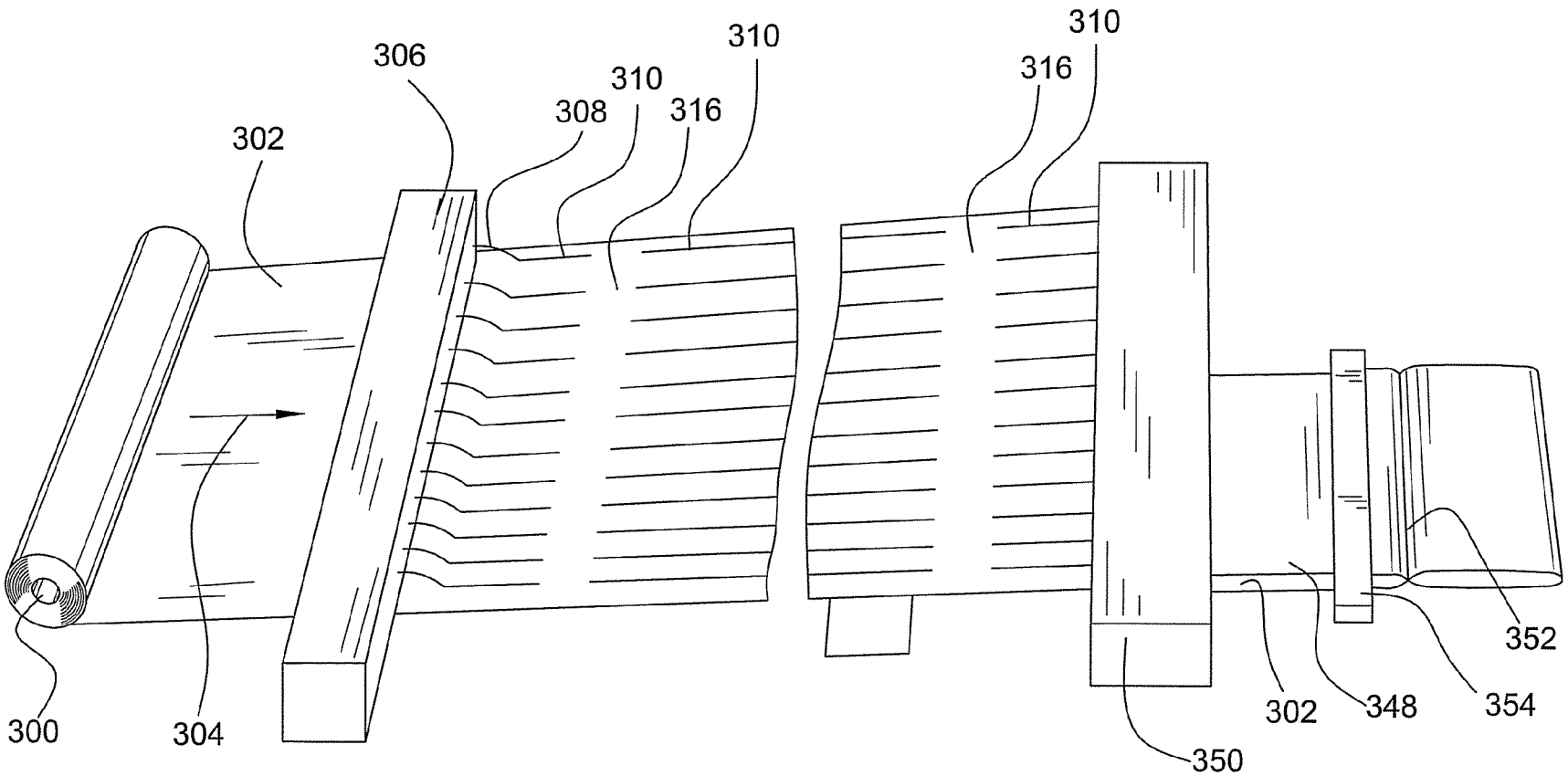
FIG. 9 is a schematic illustrating an embodiment of processing steps for manufacturing a flexible bag having elongate ridges formed along an interior surface.
Figure 10:
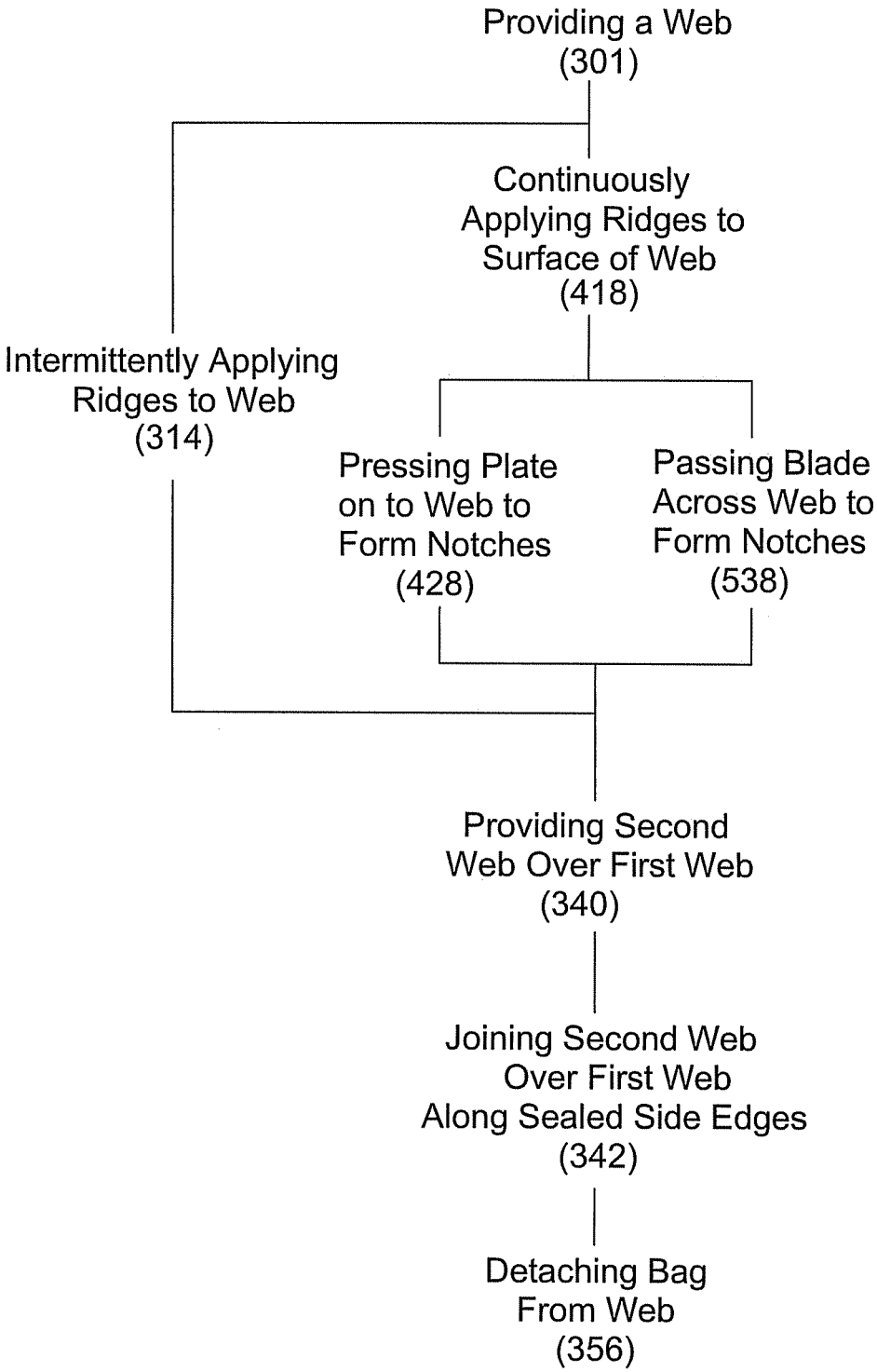
FIG. 10 is a flow chart illustrating possible embodiments of processing steps for manufacturing a flexible bag having elongated ridges along an interior surface.

To provide notches within the ridges, the lines of ridge material from the extrusion device can be intermittently applied or pulsated onto the web, as represented by step 314 of FIG. 10. More specifically, referring to FIG. 9, as the web 302 continuously passes the extrusion apparatus 306, the lines 308 of ridge material are extruded for a first time duration, discontinued for a second time duration, and then applied for a third time duration. Each intermittent application of material will provide separate ridge segments with intermediate notches 316.

Figure 11:
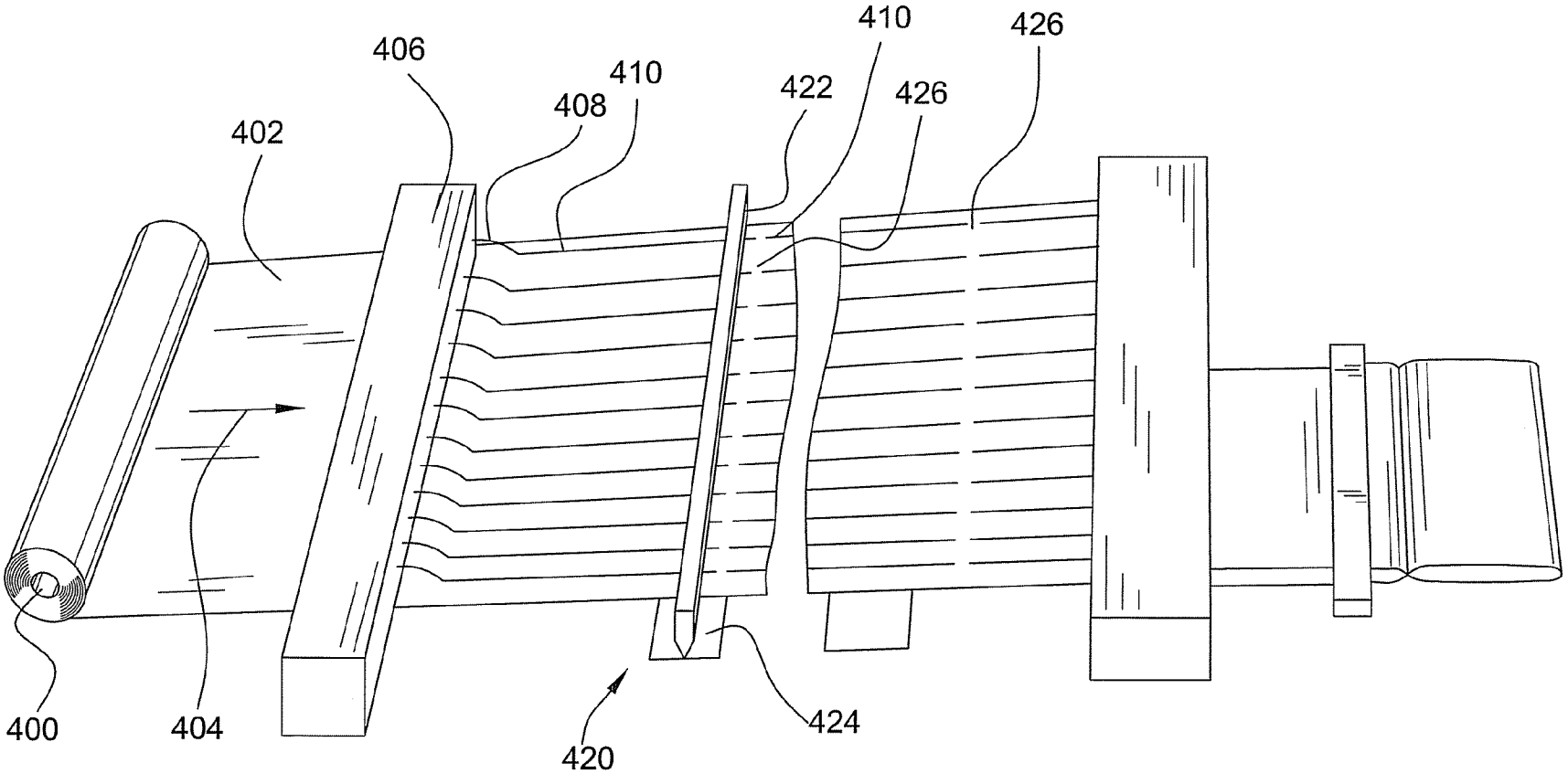
FIG. 11 is a schematic illustrating another embodiment of processing steps for manufacturing a flexible bag having ridges.

The notches can also be formed subsequent to the continuous application of the lines to the web, which in FIG. 10 is represented by step 418. For example, referring to FIG. 11, the web 402 with the added extrusion lines can pass through a press apparatus 420. The press apparatus 420 includes a movable wedge 422 and a press plate 424 between which the web 402 passes. When activated, the wedge 422 will press down upon the web 402 and press plate 424 to flatten or displace a portion of the ridges 410 and thereby provide the intermediate notches 426. The pressing operation is represented in FIG. 10 by step 428.

Figure 12:
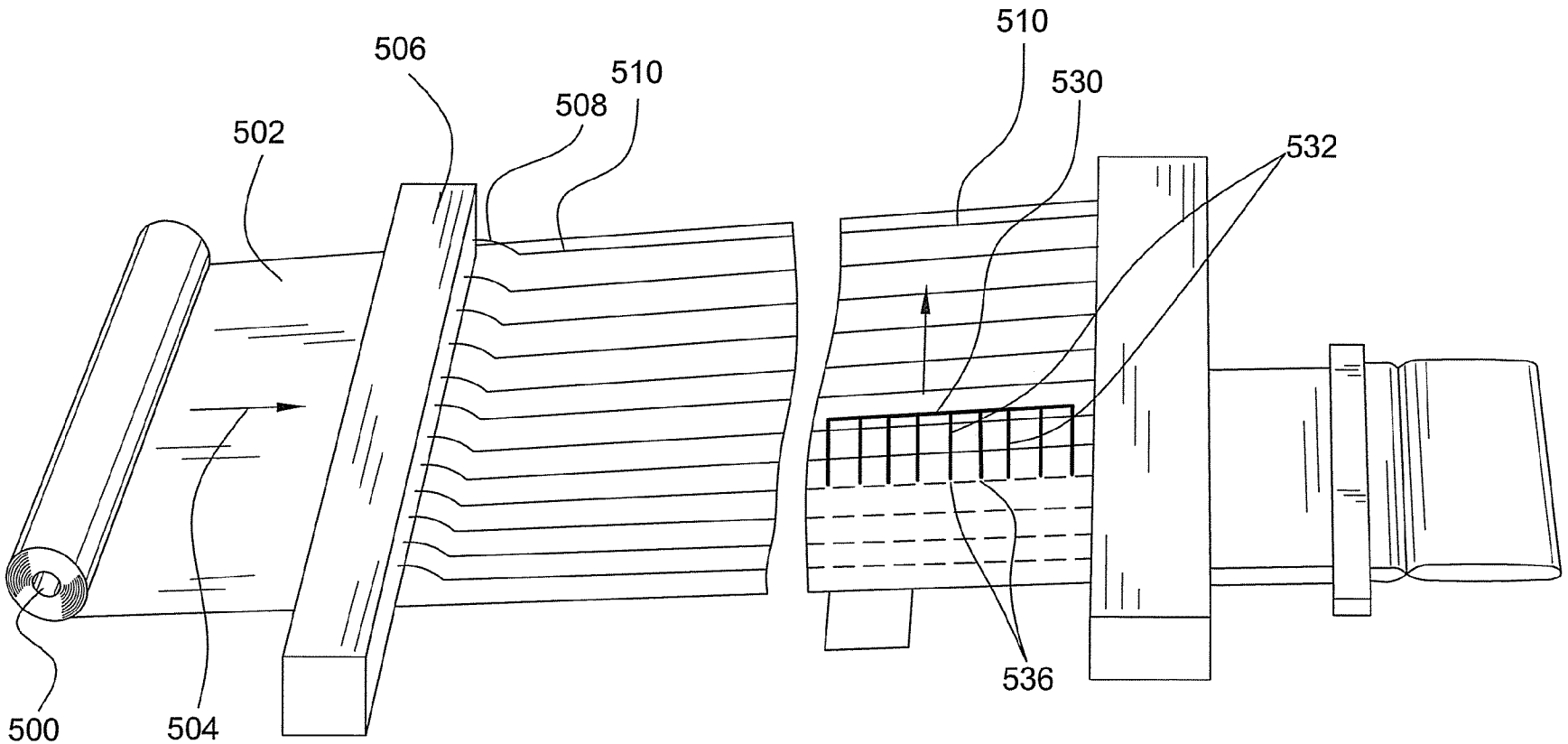
FIG. 12 is a schematic illustrating another embodiment of processing steps for manufacturing a flexible bag having ridges.

In another embodiment, the notches can be formed by cutting away material from the ridges. For example, referring to FIG. 12, a rake 530 having sharpened prongs or blades 532 can be moved over the web with the applied ridges in a direction perpendicular to the machine direction indicated by arrow 504. As the blades 532 contact the ridges 510, material is cut away to provide the intermediate notches 536. The cutting away of ridge material to form notches is represented by step 538 of FIG. 10.

After the notches have been formed, the web 302 can be further manipulated to produce the finished bag. Specifically, as represented by steps 340 and 342 of FIG. 10, a second web can be placed over the first web and joined thereto to provide what will be the first and second sidewalls of the finished bag. Referring to FIG. 9, one method of providing the second web 348 is to fold the first web 302 in half through a folding operation 350. The overlaying webs 302, 348 are then passed through a sealing operation 352 wherein the side seals 354 are formed. Finally, as represented by step 356 in FIG. 10, the finished bag can be detached from the webs for packaging and distribution. The valve element and the interlocking fastening strips may be added at various locations in the process.

Figure 13:
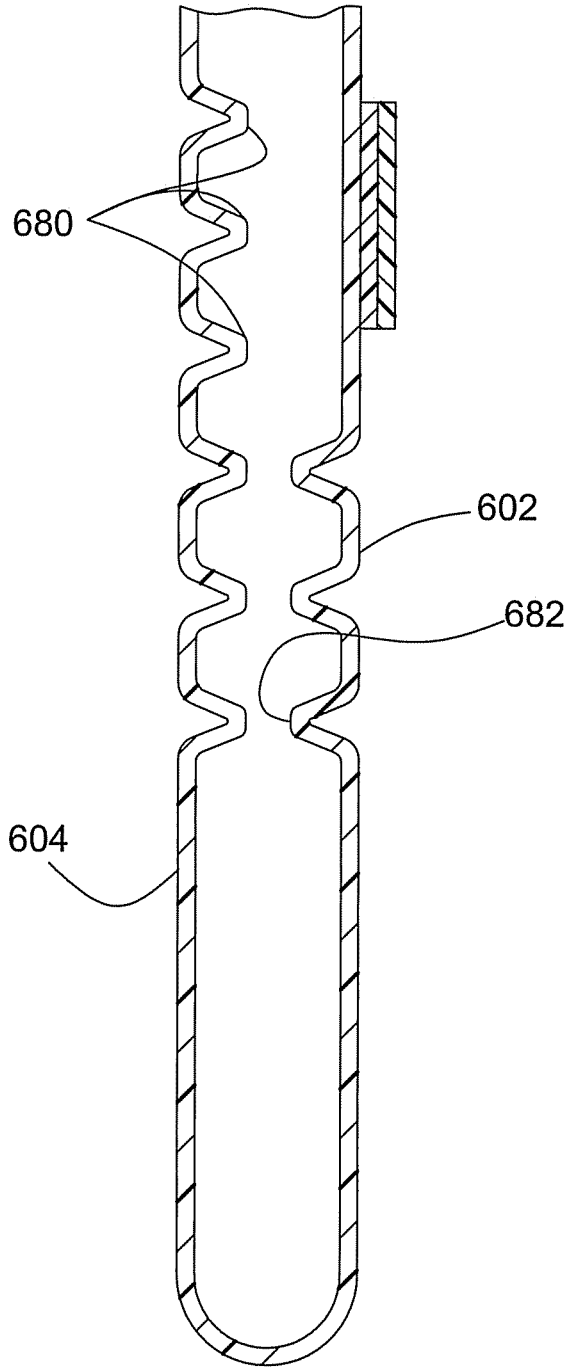
FIG. 13 is a cross-sectional view of another embodiment of the bag.

In other embodiments, the ridges can be formed by other techniques. For example, the web that will be formed into the flexible sidewall can be embossed during an embossing operation to emboss the plurality of ridges from the plane of the web. Referring to FIG. 13, the ridges 680, 682 may be embossed into the sidewalls 602, 604. In other embodiments, the ridges may be embossed only on one of the sidewalls. The sidewall may be embossed by using an embossing roller or other embossing technique. In other embodiments, the ridges can be formed separately and laminated, adhered, or heat fused onto the web. In other embodiments, the ridges can be formed by scraping or gouging the web. For example, a web having a suitable thickness can be passed under one or more blades that removes material from the web. The material remaining on the web forms the parallel protruding ridges.

Figure 14:
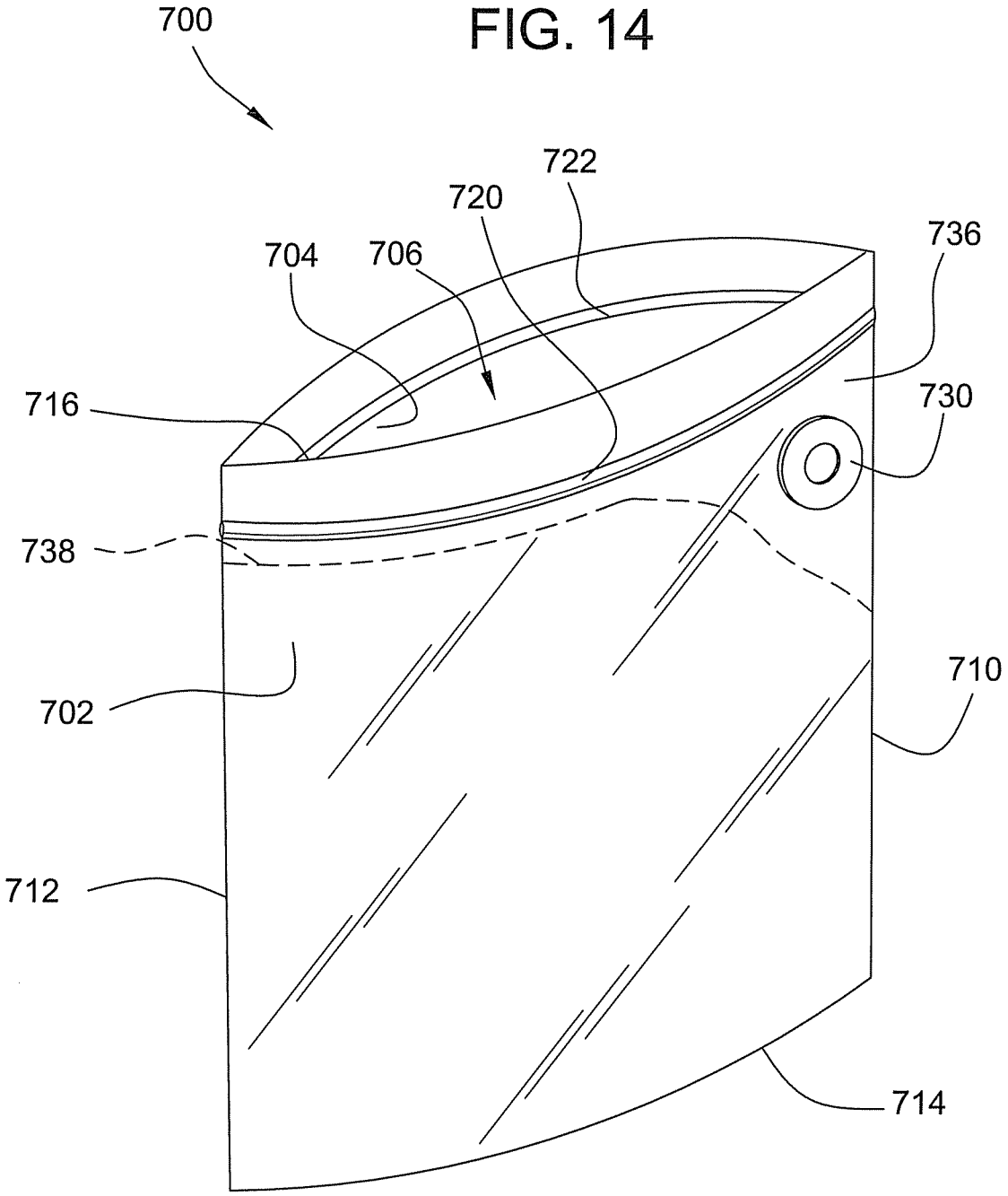
FIG. 14 is a front elevational view of a flexible plastic bag having a valve element located proximate the intersection of the bag opening and sealed peripheral edge and the contents of the bag indicated by a dashed line.
Figure 15:
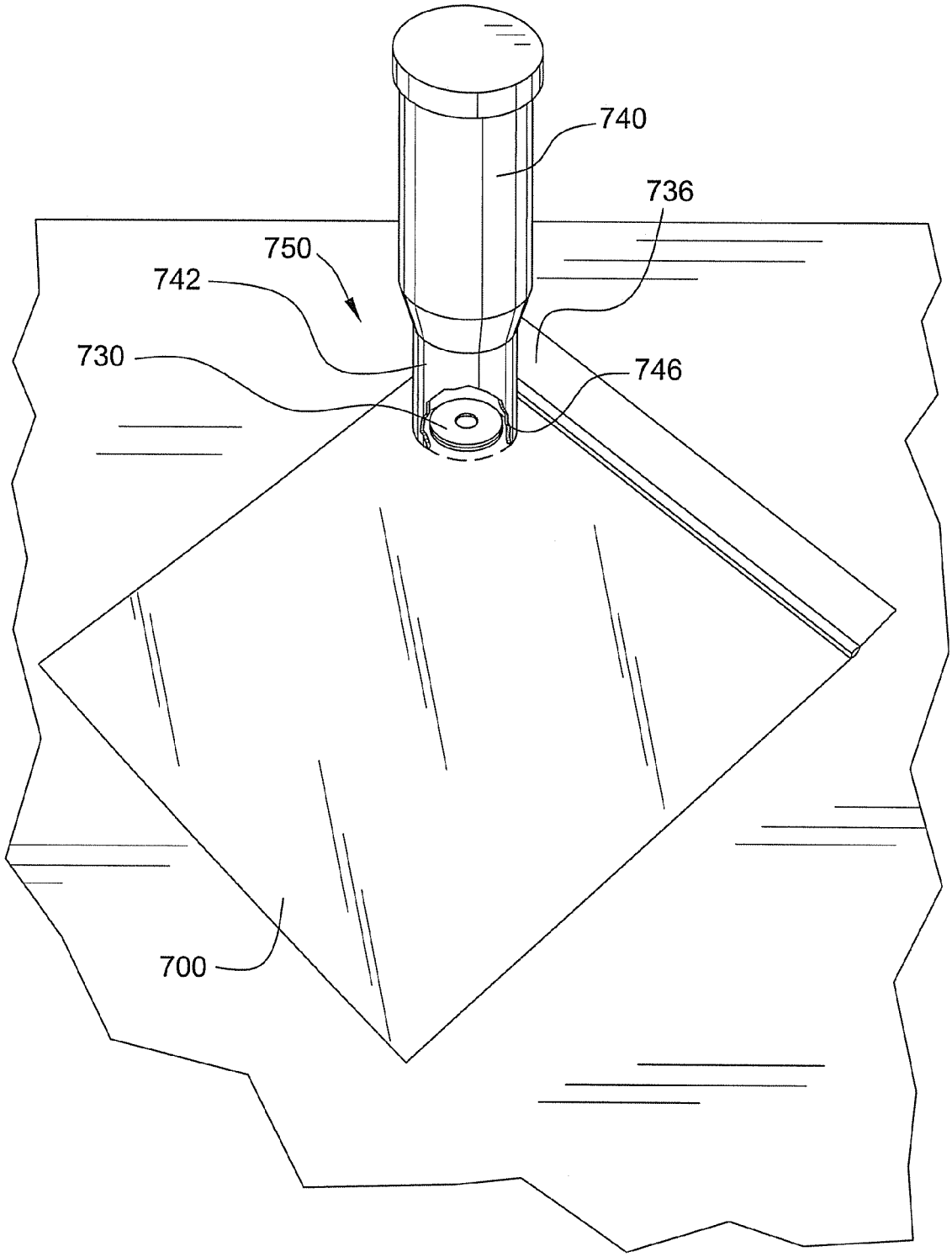
FIG. 15 is a perspective view of the bag of FIG. 14 wherein the corner of the bag is placed adjacent a horizontal surface and interfaced with a vacuum device.

In another aspect of the invention, to maintain separation of the valve element from potential clogging objects within the bag, the valve element can be placed at a beneficial location on the bag. For example, referring to FIG. 14, the bag 700 is provided with a first sidewall 702 overlaying and joined to a similarly shaped second sidewall 704 to provide an interior volume 706. While the bag 700 can have any suitably shaped periphery, in the illustrated embodiment, the first and second sidewalls 702, 704 are joined along a first side edge 710, a parallel second side edge 712, and a closed bottom edge 714 such that the bag has a rectangular shape. To access the interior volume 706, the edges of the first and second sidewall 702, 704 located opposite the closed bottom edge remain unjoined to provide an opening 716. To releasably seal the opening 716, first and second interlocking fastening strips 720, 722 can be provided that extend parallel to the opening. To evacuate the interior volume 706, a vacuum device such as the hand held device 740 shown in FIG. 15 can be provided to interface with and draw air through the valve element 730.

The valve element 730, which can be any of the aforementioned styles of valve elements, is attached to the first sidewall 702 so as to communicate with the interior volume 706. Specifically, the valve element 730 is illustrated proximate the intersection formed by the opening 716 and the first side edge 710 and more specifically in the upper corner 736 of the bag 700. For example, in a first range the center of the valve element 730 can be located below the opening 716 between 0.050 inches (1.27 cm) and 4.0 inches (10.16 cm). In a second range the center of the valve element 730 can be located below the opening 716 between 0.75 inches (1.91 cm) and 3.0 inches (7.62 cm). In a third range the center of the valve element 730 can be located below the opening 716 between 1.0 inches (2.54 cm) and 2.0 inches (5.08 cm). In addition, in a first range the center of the valve element 730 can be located from the first side edge 710 between 0.50 inches (1.27 cm) and 4.0 inches (10.16 cm). In a second range the center of the valve element 730 can be located from the first side edge 710 between 0.75 inches (1.91 cm) and 3.0 inches (7.62 cm). In a third range the center of the valve element 730 can be located from the first side edge 710 between 1.0 inches (2.54 cm) and 2.0 inches (5.08 cm). In one embodiment, the center of the valve element 730 can be located 1.5 inches (3.81 cm) below the opening 716 and 1.5 inches (3.81 cm) from the first side edge 710. In this location, the valve element 730 is sufficiently spaced apart from the closed bottom edge 714 where the contents of the bag 700 will typically collect. Accordingly, the valve element 730 remains spaced away from the potential clogging contents within the interior volume during evacuation.

Another advantage of locating the valve element 730 in the upper corner 736 of the bag 700 is that it maximizes the interior volume 706 that can accommodate contents while still maintaining sufficient separation between those contents and the valve element. For instance, referring to FIG. 14, with the exception of upper corner 736 with the attached valve element 730, the interior volume 706 can be filled with contents as indicated by dashed line 738. Hence, the usable amount of the interior volume and the amount of contents received by the bag are maximized.

Another advantage is that locating the valve element 730 in the upper corner 736 facilitates evacuation of the interior volume 706 with a vacuum device. For example, referring to FIG. 15, the empty upper corner 736 can be placed against a planar horizontal surface 750, such as a table top, and the valve element 730 pressed flat against that surface. The nozzle 742 of a vacuum device 740 can be placed about the valve element 730 and activated to evacuate the bag. The inlet opening 746 of the nozzle 742 may have a diameter larger than the diameter of the valve element so that the nozzle rim can contact the thermoplastic material of the sidewall. Because the valve element 730 and upper corner 736 are flat against the horizontal surface, as opposed to being situated at an uneven portion of the sidewalls overlying the bag contents, a sufficient seal can be achieved between the vacuum nozzle 742 and the bag 700.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventor(s) for carrying out the invention. Variations of those preferred embodiments may become apparent to those of ordinary skill in the art upon reading the foregoing description. The inventor(s) expect skilled artisans to employ such variations as appropriate, and the inventor(s) intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A storage bag comprising:

a first sidewall;

a second sidewall overlaying the first sidewall to provide an interior volume between opposing first and second inner surfaces of the respective first and second sidewalls, at least one inner surface including a plurality of protruding, elongated ridges, at least one ridge having a depth and plurality of notches to provide a plurality of ridge segments, wherein the notches are of unequal depth such that at least one notch has a depth A and at least one notch has a depth B and depth A is greater than depth B; and a one-way valve element attached to one of the first sidewall and the second sidewall, the valve element communicating with the interior volume through an aperture in the sidewall.

2. The storage bag of claim 1, wherein depth A is equal to the depth of the ridge.

3. A storage bag comprising:

a first sidewall;

a second sidewall overlaying the first sidewall to provide an interior volume between opposing first and second inner surfaces of the respective first and second sidewalls, at least one inner surface including a plurality of protruding, elongated ridges, at least one ridge having a depth and a plurality of notches to provide a plurality of ridge segments, wherein the notches are of unequal depth such that at least one notch has a depth A and at least one notch has a depth B and depth A is greater than depth B; and a one-way valve element attached to one of the first sidewall and the second sidewall, the valve element communicating with the interior volume through an aperture in the sidewall, wherein at least one notch is over the aperture in the sidewall.

4. The storage bag of claim 3, wherein the elongated ridges are parallel.

5. The storage bag of claim 4, wherein the at least one elongated ridge is straight and the plurality of ridge segments are aligned together.

6. The storage bag of claim 5, wherein depth A is equal to the depth of the ridge.

7. The storage bag of claim 6, wherein the length of each notch is in a range from 1% to 50% of the length of each ridge segment.

8. The storage bag of claim 3, wherein the one-way valve element has a flexible base layer attached over the aperture and the one way valve element has a top layer overlying the base layer.

9. The storage bag of claim 3, wherein the first sidewall and second sidewall are joined together along a first side edge, a parallel second side edge, and a bottom edge extending between the first and second side edges.

10. The storage bag of claim 9, wherein the plurality of ridges extend between the first side edge and the second side edge.

11. The storage bag of claim 10, wherein the plurality of ridges are arranged generally perpendicular to the first side edge and the second side edge.

12. The storage bag of claim 9, wherein the plurality of ridges are arranged generally parallel to the first side edge and the second side edge.

13. The storage bag of claim 3, wherein the ridges are extruded onto the inner surface and the notches are subsequently formed into the ridges.

14. The storage bag of claim 3, wherein the ridges and notches are simultaneously formed onto the inner surface.

* * * * *